US005670735A

United States Patent [19]

Ortmann et al.

[11] Patent Number: 5,670,735

[45] Date of Patent: Sep. 23, 1997

[54] PROPELLANT IGNITING SYSTEM AND METHOD OF MAKING THE SAME

[75] Inventors: Helmut Ortmann, Duisburg; Günter Frye, Erkrath; Rainer Böhm, Fassberg; Manfred Lübben, Celle, all of Germany

[73] Assignee: Rheinmetall Industrie GmbH, Ratingen, Germany

[21] Appl. No.: 577,393

[22] Filed: Dec. 22, 1995

[30] Foreign Application Priority Data

Dec. 22, 1994 [DE] Germany ..... 44 45 991.2

[51] Int. Cl.[6] ..... F42C 19/085

[52] U.S. Cl. ..... 102/202; 102/205; 102/275.11; 102/282; 102/431; 102/470; 60/256; 86/1.1; 149/2; 149/109.6; 264/3.1

[58] Field of Search ..... 102/202, 205, 102/275.11, 282, 288, 318, 322, 380, 430–433, 470, 530, 531, 700; 264/3.1, 3.2; 149/2, 109.6; 86/1.1; 60/256

[56] References Cited

U.S. PATENT DOCUMENTS

| | | | |
|---|---|---|---|
| 4,864,932 | 9/1989 | Reinelt et al. | 102/282 |
| 4,922,823 | 5/1990 | Rahnenfuhrer et al. | 102/275.11 |
| 5,269,224 | 12/1993 | Gonzales et al. | 102/431 |
| 5,454,323 | 10/1995 | Conil | 102/282 |

FOREIGN PATENT DOCUMENTS

| | | | |
|---|---|---|---|
| 2 509 038 | 1/1983 | France . | |
| 3447276 | 6/1986 | Germany | 102/431 |
| 42 23 735 | 1/1994 | Germany . | |
| 40105572 | 4/1993 | Japan | 102/282 |
| 2160625 | 12/1985 | United Kingdom | 102/202 |
| 2259753 | 3/1993 | United Kingdom | 102/470 |

*Primary Examiner*—Harold J. Tudor
*Attorney, Agent, or Firm*—Spencer & Frank

[57] ABSTRACT

An igniting system for a projectile propellant includes a combustible support tube having an outer surface and an inner surface; a plurality of throughgoing apertures provided in the support tube; a free igniting channel coaxially surrounded by the support tube; and an ignition transfer charge formed of a pyrotechnical hard foam layer having a thickness between 1 and 3 mm and being carried on the outer surface of the support tube. The hard foam layer is composed of a large-pore inner layer and two opposite surface layers which are of densely closed structure and between which the inner layer is sandwiched.

26 Claims, 1 Drawing Sheet

PROPELLANT IGNITING SYSTEM AND METHOD OF MAKING THE SAME

BACKGROUND OF THE INVENTION

This invention relates to an igniting system for projectile propellants and is of the type that has an apertured support tube made of a combustible material which coaxially surrounds a free igniting channel. An ignition transfer charge is arranged on the outer surface of the support tube, that is, on that tube side which is oriented toward the propellant. The invention also relates to a method of making ignition systems of this type.

German Offenlegungsschrift (application published without examination) 42 23 735 discloses a vacuum ignition system particularly for modular propellants of large-caliber ammunition in which, for obtaining short ignition times, the individual propellant modules each have an apertured support tube made of a combustible material which surrounds an axial ignition channel. On the side oriented towards the propellant powder the support tube carries an ignition transfer charge which essentially is formed of propellant pellets coated with an igniting mixture approximately 0.1 mm thick and made of black powder bound in nitrocellulose. Preferably, the pellets coated with the igniting mixture are arranged in a combustible vacuum tube, for example, a shrunkon sleeve.

As it is further disclosed in the above-identified Offenlegungsschrift, the support tube, in addition to the igniting transfer charge proper, may be provided on its inner and outer surfaces with a thin layer of igniting mixture of the type described above.

It is a significant disadvantage of the igniting system of the above-outlined type that the pellets coated with an igniting mixture are relatively expensive to manufacture and further, it is significantly time-consuming to uniformly arrange the coated pellets about the support tube. As a rule, such a manipulation requires additional process steps.

SUMMARY OF THE INVENTION

It is an object of the invention to provide an improved igniting system of the above-outlined type which is adapted to ignite multipart propellant structures, which has a short period for igniting the propellant and which may be made in a simple and economical manner.

This object and others to become apparent as the specification progresses, are accomplished by the invention, according to which, briefly stated, the igniting system for a projectile propellant includes a combustible support tube having an outer surface and an inner surface; a plurality of throughgoing apertures provided in the support tube; a free igniting channel coaxially surrounded by the support tube; and an ignition transfer charge formed of a pyrotechnical hard foam layer having a thickness between 1 and 3 mm and being carried on the outer surface of the support tube. The hard foam layer is composed of a large-pore inner layer and two opposite surface layers which are of densely closed structure and between which the inner layer is sandwiched.

The invention is based essentially on the principle to utilize an ignition transfer charge which is not a pellet coated with an igniting mixture, but a pyrotechnical composite hard-foam layer which has a thickness of between 1.0 and 3 mm and which has a substantially large-pore internal structure (sponge structure). The relatively thin, opposite surface layers which are oriented respectively towards the propellant powder and the support tube are, in contrast, densely-closed integral layers (skins) to ensure the required protection of the hard foam inner layer against moisture and water.

Such a hard foam layer according to the invention also ensures, even at low temperatures, a secure, rapid and reproducible ignition of the propellant powder. Further, the ignition transmission of the hard foam is surprisingly relatively independent from its structure (for example, the degree of porosity, the outer skin characteristics, the local density fluctuations, etc.). This means that the parameters for making the hard foam and its structure need not be determined with high precision as regards temperature, pressure, drying period, etc.

The ignition system according to the invention was found to be particularly advantageous by including in the pyrotechnical hard foam cellulose fibers and/or synthetic fibers. Such an addition significantly increases the strength and thus the mechanical stability of the hard foam. Further, such an addition of fibers makes possible the processing of even coarse-grained black powder. While, for example, in the igniting mixture disclosed in German Offenlegungsschrift 42 23 375 the black powder could not exceed a grain size of 0.1 mm for ensuring the application of a uniform coating to the support tube or to the propellant pellets, in the layer according to the invention the grain size of the black powder may be up to 1.5 mm. Despite the use of such large-grain black powder, a hard foam layer is obtained which has a high inner bond with the black powder and which adheres firmly to the support tube.

The use of a coarse-grained black powder has the significant advantage that the loose distribution of the relatively large black powder grains in the foam structure provide, by virtue of their large grain surface and without any appreciable increase in environmental pressures, for the most vigorous activity at the moment of ignition and at the moment of flame transmission to the propellant powder. It has been found empirically that the cellulose fiber or synthetic fiber proportion of the foam should lie between about 0.2 and 5, preferably between approximately 1–3 weight %. It is noted that these and other weight percent values to be given hereafter relate to the total weight of the composite hard foam layer.

As a first step of the method according to the invention, nitrocellulose (NC) is dissolved in an NC solvent. Thereafter, cellulose or synthetic fibers, or a mixture thereof, which are insoluble in the NC solvent, are added to the solution and homogeneously distributed therein. Then the black powder and, if required, further additives, for example, a softener are admixed and homogeneously distributed in the solution.

The igniting substance obtained in the above-described steps is applied either directly to the support tube 5 or is applied to a separate shaped body (sleeve). The applied coating is then dried, preferably at temperatures between 30° to 60° C. under a weak vacuum, so that the solvent is vaporized and thus the desired large-pore, porous inner construction as well as the coherent, flanking external surface skins are produced.

The method according to the invention is, among others, advantageous that for the manufacture of the hard foam no separate foaming agent has to be used because this function is performed by the solvent.

It has been found to be particularly advantageous to use, as the nitrocellulose, collodion cotton having a nitrogen content of between 11.5 and 12.5%. For adapting the solvent selection to the dissolving capacity of highly nitrated nitrocellulose, guncotton having a nitrogen content of more than 13% may be used. As NC-solvents which should also function as foaming agents, among others acetone, acetonitrile and various esters or ketones and appropriate mixtures have been found to be advantageous. As cellulose fibers, cotton linters or kraft pulp may be used.

For the black powder preferably soft-grain types are used and particularly also those which have different compositions of the base form, that is, their $KNO_3$-content is not only 75% but also 77% or 80%.

An acceleration of the igniting reaction and an increase of the flame temperature are achieved by adding to the igniting substance magnesium or aluminum powder in the amount of 2–12 weight %, preferably 3–5 weight %.

As softeners, dibutylphthalate and other phthalates as well as centralite have been found to be appropriate which render the otherwise relatively hard structure of the foam more elastic and flexible.

The processing of coarse-grained black powder which includes the addition of the cellulose and/or synthetic fibers causes difficulties in the thin-flowing condition, particularly in a spraying process, because the coarse grains rapidly settle and clog the spraying nozzle and may lead to non-homogeneous distributions on the tubular support. It was therefore found to be advantageous to set the process such that a high-viscosity igniting substance is obtained. Such a substance may be applied to the supporting body, for example, by means of a roll-on process.

DESCRIPTION OF THE PREFERRED EMBODIMENTS

Figure 1:
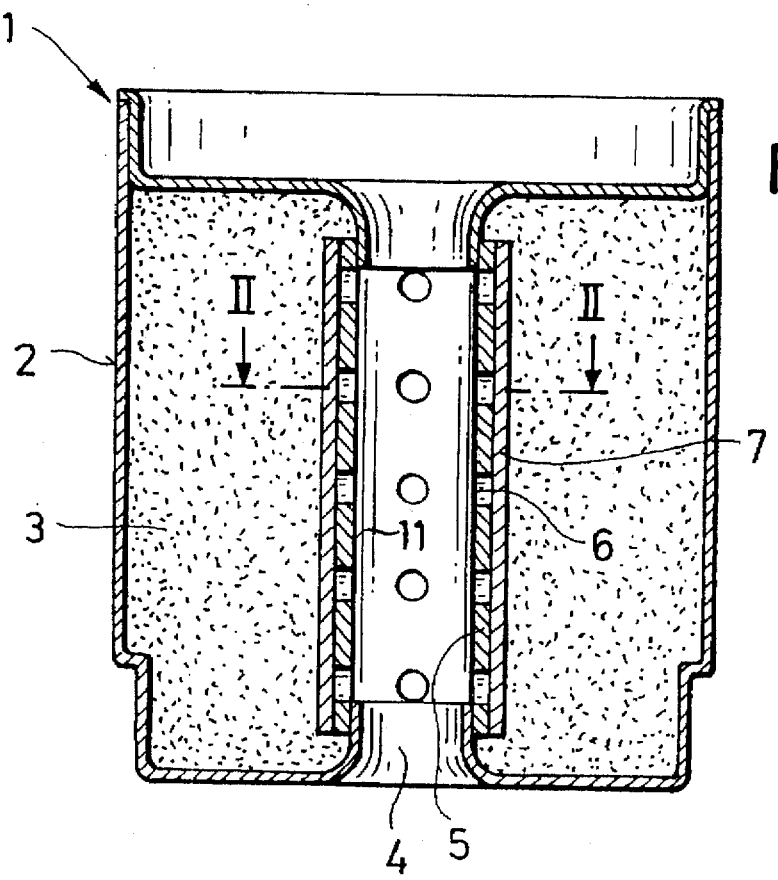
FIG. 1 is an axial sectional view of a propellant module according to a preferred embodiment of the invention.

FIG. 1 illustrates a propellant module generally designated at 1 and adapted for use in large-caliber cannons, as described, for example, in European Patent No. 306,616. The propellant module comprises a container 2 for receiving a conventional propellant powder 3. For a central ignition there is provided a free igniting channel 4 which is laterally defined by a combustible support tube 5 centrally held by the housing 2. The support tube 5 is provided with a plurality of apertures 6.

Figure 2:
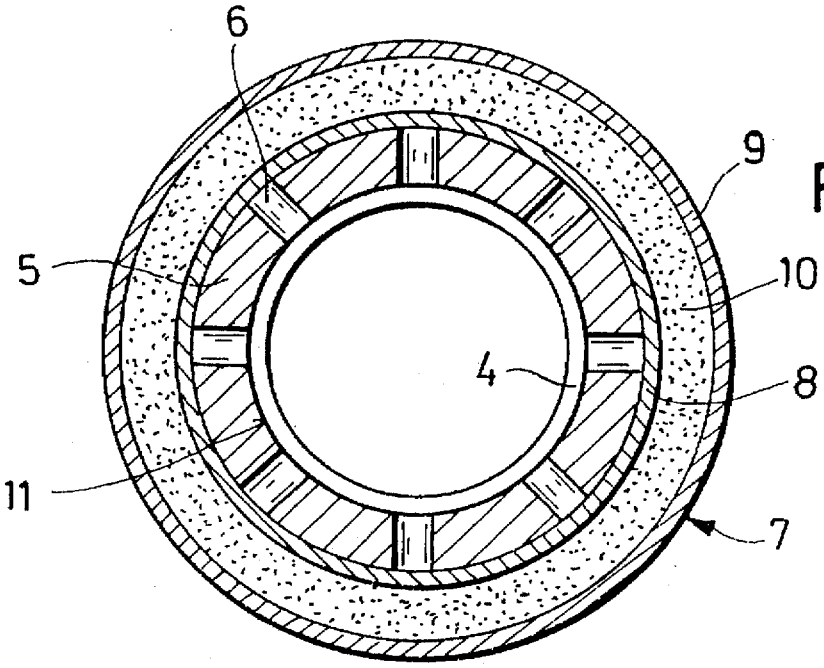
FIG. 2 is an enlarged sectional view taken along line II—II of a central portion of the construction shown in FIG. 1.

According to the invention the outer surface of the support tube 5, that is, that side of the support tube 5 which faces the propellant powder 3 is provided with a composite, pyrotechnical hard foam coating 7 constituting an ignition transfer charge having essentially a three-layer structure as shown in FIG. 2. The surface layers 8 and 9 which form part of the hard foam coating 7 and which are, respectively, oriented towards the propellant powder 3 and the support tube 5, constitute densely closed skins whose density should be greater than 1 $g/cm^3$ and which protect the hard foam coating against moisture. The inner layer 10 situated between the surface layers 8 and 9 has a large-pore, porous foam structure, whose foam density is between 0.4 and 0.9 $g/cm^3$.

That surface of the support tube 5 which faces the igniting channel 4 is coated with a thin pyrotechnical lacquer layer (igniting layer) 11.

In the description which follows, the operation of the igniting system according to the invention will be described.

After igniting a non-illustrated igniter, the hot ignition gases enter the ignition channel 4, ignite there both the pyrotechnical lacquer layer 11 and, through the apertures 6, the surface layer 8 and then the large-pore inner layer 10 containing the readily ignitable black powder grains. The loose distribution of the large-surface black powder grains in the foam structure ensure at the moment of flame transfer to the propellant powder the most vigorous flame expansion activity without any appreciable environmental pressure increase. This results in an instantaneous, impact-like ignition of the propellant powder along a broad zone because the burning hard foam parts are hurled into the propellant powder as they burn on all sides.

For making the pyrotechnical hard foam, nitrocellulose (NC), for example, collodion cotton having a nitrogen content of between 11.5 and 12.5% or guncotton with a nitrogen content of in excess of 13% is dissolved in a solvent, such as acetonitrile. Thereafter, a kraft pulp fiber mixture is added to the solution and is homogeneously distributed therein. Subsequently, the black powder, preferably having a grain size between 0.2 and 1.5 mm and, if required, a softener agent are added. Also, for increasing the flame temperature and for accelerating the ignition reaction, magnesium and/or aluminum powder of a grain size less than 0.1 mm is admixed to the solution in an amount of 2 to 12 weight % (preferably 3 to 5 weight %) and is distributed therein. The viscosity of such a mixture is relatively high (greater than 5000 Pa*s), resulting in a dough-like igniting substance.

Before applying the igniting substance to the supporting tube 5, first the pyrotechnical lacquer layer 11 is applied, for example, by spraying and subsequent drying. Thereafter, an approximately 1 to 3 mm thick layer of the igniting substance is, for example, through a wide slotted nozzle, placed onto the outer surface of the support tube 5 by means of a piston pump dispenser. By means of its thixotropic setting, based by the admixture of the cellulose fiber mixture, the igniting substance remains on and adheres to the support tube 5. The support tube 5 is thereafter placed into a drying tunnel in which a temperature of 30° to 60° C. and a vacuum of approximately 700 mbar prevail for expelling the solvent on the surface by evaporation. The igniting substance is thus depleted of the solvent and thus forms a coherent surface film which corresponds to the surface layer 9 illustrated in FIG. 2. In the inside, underneath the surface layer 9, the igniting substance foams by virtue of the evaporation of the solvent and there is obtained a hardening foam structure whose thickness is between 0.5 and 2 mm, dependent upon the selected layer thickness for the igniting substance. The vapors escape through the pores in the outer skin and are precipitated in a cold sink, from which the solvent is recuperated.

On the inner surface of the igniting substance layer that is, on its side oriented towards the support tube 5 there is also formed a closed film, designated at 8 in FIG. 2, which adheres to the support tube 5. The solvent is drawn into the porous support tube 5 by capillary action.

Instead of applying the hard foam layer directly to the support tube 5, it is feasible as an alternative, to first form a parison of the igniting substance which corresponds to the outer dimensions of the support tube 5. For this purpose, the soft or liquid igniting substance is applied to a sieve-like carrier sleeve. The vapors may be drawn into the inside of the carrier sleeve by applying a weak vacuum. By means of the applied temperature and vacuum, the thickness of the hard foam layer and its porosity may be controlled. After the drying step, the hard foam layer which assumed the dimensions and contour of the support tube 5, may be pulled off the carrier sleeve by applying to the inside of the carrier sleeve a slight pressure and thereafter the hard foam layer may be inserted on the support tube 5. For such a procedure, the support tube is preliminarily processed by providing it on both sides with a lacquer, for example, by spray-coating. The lacquer then forms the inner layer of the apertured support tube 5 and further, the outer lacquer layer on the support tube 5 forms an adhesive bond between the support tube 5 and the inserted hard foam igniting substance 7.

It will be understood that the above description of the present invention is susceptible to various modifications, changes and adaptations, and the same are intended to be comprehended within the meaning and range of equivalents of the appended claims.

What is claimed is:

1. An igniting system for a projectile propellant, comprising (a) a combustible support tube having an outer surface and an inner surface;

(b) a plurality of throughgoing apertures provided in said support tube;

(c) a free igniting channel coaxially surrounded by said support tube; and (d) an ignition transfer charge formed of a pyrotechnical hard foam layer having a thickness between 1 and 3 mm and being carried on said outer surface of said support tube; said hard foam layer including a large-pore inner layer sandwiched between surface layers of densely closed structure.

2. The igniting system as defined in claim 1, wherein said pyrotechnical hard foam layer contains a material in the amount of 2–12 weight % selected from the group consisting of magnesium powder and aluminum powder having a grain size less than 0.1 mm.

3. The igniting system as defined in claim 2, wherein said amount is 3–5 weight %.

4. The igniting system as defined in claim 1, further comprising a pyrotechnical lacquer coating provided on said inner surface of said support tube.

5. An igniting system for a projectile propellant, comprising (a) a combustible support tube having an outer surface and an inner surface;

(b) a plurality of throughgoing apertures provided in said support tube;

(c) a free igniting channel coaxially surrounded by said support tube; and (d) an ignition transfer charge formed of a pyrotechnical hard foam layer having a thickness between 1 and 3 mm and being carried on said outer surface of said support tube; said hard foam layer including a large-pore inner layer sandwiched between surface layers of densely closed structure; said pyrotechnical hard foam layer being a mixture of nitrocellulose and black powder; said mixture containing fibers selected from the group consisting of cellulose fibers and synthetic fibers.

6. The igniting system as defined in claim 5, wherein the amount of said fibers is 0.5 to 5 weight %.

7. The igniting system as defined in claim 6, wherein said amount is 3 weight %.

8. The igniting system as defined in claim 5, wherein the mean grain size of said black powder is between 0.2 and 1.5 mm.

9. A method of making an igniting system for a propellant charge including a combustible, apertured support tube coaxially surrounding a free igniting channel, comprising the steps of (a) obtaining a solution by dissolving nitrocellulose in a nitrocellulose solvent;

(b) adding fibers to the solution and homogeneously distributing the fibers therein; said fibers being non-soluble in the solvent and being selected from the group consisting of cellulose fibers and synthetic fibers;

(c) adding black powder to the solution and distributing said black powder therein;

(d) applying the material obtained in steps (a), (b) and (c) externally to a tubular body; said tubular body being selected from the group consisting of said apertured support tube and a sleeve separate from said apertured support tube; and (e) drying the material at a presettable temperature and a presettable vacuum for evaporating the solvent to obtain on the tubular body a hard foam layer formed by a large-pore, porous layer sandwiched between two coherent, densely closed surface layers.

10. The method as defined in claim 9, wherein said tubular body is said sleeve; further comprising the step of (f) removing said hard foam layer from said sleeve; and (g) inserting said hard foam layer on said support tube.

11. The method as defined in claim 9, further comprising the step of adding a softener to said solution.

12. The method as defined in claim 9, wherein said solvent is selected from the group consisting of acetone, acetonitrile, ester and ketone.

13. The method as defined in claim 9, wherein said nitrocellulose is selected from the group consisting of collodion cotton and guncotton having a nitrogen content of at least 11.5%.

14. The method as defined in claim 9, wherein said cellulose fibers are selected from the group consisting of kraft pulp and cotton linters.

15. The method as defined in claim 9, wherein said black powder has a grain size between 0.2 and 1.5 mm.

16. The method as defined in claim 9, wherein said black powder is composed of first and second parts; said first part having a $KNO_3$ content of 75 weight % and said second part having a $KNO_3$ content of 77 weight %.

17. The method as defined in claim 9, wherein said black powder is composed of first and second parts; said first part having a $KNO_3$ content of 75 weight % and said second part having a $KNO_3$ content of 80 weight %.

18. The method as defined in claim 9, further comprising the step of adding a further powder to said solution in the amount of 2–12 weight %; said further powder having a grain size of less than 0.1 mm and being selected from the group consisting of magnesium powder and aluminum powder.

19. The method as defined in claim 18, wherein the amount of said further powder is 3–5 weight %.

20. The method as defined in claim 9, further comprising the step of adding a softener to said solution in the amount of 1–6 weight %.

21. The method as defined in claim 20, wherein the amount of said softener is 1–3 weight %.

22. The method as defined in claim 20, wherein said softener is selected from the group consisting of centralite and dibutyl phthalate.

23. The method as defined in claim 20, wherein said softener contains a phthalate.

24. The method as defined in claim 9, further comprising the step of thixotropically setting set solution; said solution having a viscosity of at least 5,000 Pa*s.

25. The method as defined in claim 9, wherein step (d) comprises the step of applying said material with a roller.

26. The method as defined in claim 9, wherein step (d) comprises the step of applying said material with a wide-slotted nozzle.

* * * * *